United States Patent [19]

Staroba et al.

[11] 3,946,747

[45] Mar. 30, 1976

[54] CIGARETTE CUTTING TRAY

[75] Inventors: Miro O. Staroba, Weston; Alex Suchostawaski, Mississauga, both of Canada

[73] Assignee: V-Master Limited, Scarborough, Canada

[22] Filed: Oct. 3, 1974

[21] Appl. No.: 511,537

[52] U.S. Cl. ..... 131/46

[51] Int. Cl.[2]... A24C 1/24; A24C 1/36; A24C 3/00; A24C 5/12

[58] Field of Search ..... 131/46–48, 131/54, 56, 63, 65, 66, 67, 86, 91, 172; 83/425.3, 167; 30/293, 304

[56] References Cited

UNITED STATES PATENTS 2,740,443 4/1956 Brown et al. ..... 131/46 X 3,515,147 6/1970 Sledge et al. ..... 131/46 X

*Primary Examiner*—Robert W. Michell
*Assistant Examiner*—V. Millin
*Attorney, Agent, or Firm*—W. Charles Kent

[57] ABSTRACT

An improved machine for rolling cigarettes of the type in which tobacco is compressed and rolled onto a piece of cigarette paper by a moving bight in an apron formed between a roller and a platform and is subsequently dropped onto a cutting surface of a cutting tray where blades sever the cigarette to the desired length, in which the cutting surface is made of plastic and the cutting blades are fixedly engaged in blade holders. A series of spaced, parallel slots at the rear of the cutting surface provide frictional engagement for the blade holders. Safe, uniform and accurate insertion and withdrawal of the blades is thereby achieved.

8 Claims, 5 Drawing Figures

CIGARETTE CUTTING TRAY

BACKGROUND OF THE INVENTION

This invention relates to improvements in manually operated, apron-type machines for making cigarettes. More particularly, this invention relates to an improved cutting tray for such cigarette making machines which produce a plurality of individual cigarettes simultaneously.

U.S. Pat. No. 2,740,433 of W. R. Brown et al., issued Apr. 3, 1956, describes an apron-type cigarette making machine of the general type under consideration. Essentially, the machine consists of a horizontal platform covered by a flexible apron fixed to and extending from the front of said platform to beyond the rear thereof where it is similarly fixed. A roller extends transversely from side to side across the machine beneath the apron and on top of the platform. The apron has sufficient slack in it to form a cigarette-forming trough behind the platform when the roller is in its rearward position, As the roller slides forward from this position, a moving bight is formed in the apron between the roller and the platform. Tobacco placed in the trough is compressed and rolled in this bight onto a piece of cigarette paper placed on the apron above the platform. The rolled "long" cigarette is then dropped from the bight at the front of the platform down a cutting slot onto a cutting surface where, by sliding the surface and blades rearwardly towards a downwardly and rearwardly curved projection from the lower portion of the front of the platform, a series of rearwardly slanted blades cut the rolled long cigarette into a number of cigarettes of a desired length. A single-bladed machine is described by Sledge et. al. in U.S. Pat. No. 3,515,147 issued June 2, 1970.

Earlier versions of such cigarette makers required withdrawal of the long cigarette dropped rom the apron, placing this cigarette in a cutting block, and cutting this cigarette manually to the desired length. The later versions of the machine, described above, incorporated the cutting step as a further step in the operation of the machine, thereby avoiding the necessity of manually withdrawing and cutting the long cigarette produced.

One of the chief problems created with these later versions has been the insertion or removal of blades from the machine and (particularly where a series of blades has been used to obtain a greater number of cigarettes from the long cigarette), the proper alignment of the blades once inserted. In Brown et. al. U.S. Pat. No. 2,740,433, the blades were positioned by resting them vertically on ledges beneath the platform to achieve the desired slant, and positioning blocks on either side of each blade to fix the blades in place. Not only does such a construction require much time consuming manipulation by the operator to ensure that the blades are properly oriented and secured, it has proved itself to be a difficult and costly one to manufacture.

As a result, manufacturers have sought more economical and simpler means of orienting the blades on the cutting surface. In one present commercial version, the cutting surface consists of two spaced stamped sheet metal plates, each having a series of location tabs punched therefrom and bent into an upright position, a tab from one sheet cooperating with a tab from the other sheet to clamp therebetween, at a predetermined slant and orientation, a particular cutting blade. Dimples in one tab cooperate with openings in the other to more securely lock the blade in place. By sliding one sheet in relation to the other, cooperating tabs are separated to permit removal of the blades. Several difficulties are inherent with this type of cutting surface. In the first place removal and insertion of the blades for replacement purposes is awkward and difficult. The cutting surface is designed not to be removed from the machine as a whole and requires the steps of removal of a safety guard (positioned above the blades so that the blades are not exposed at the front of the machine), sliding one sheet sideways, in relation to the other to loosen the blades between the tabs, and finally careful removal by hand of each individual blade. The complexity of this operation, as well as the danger inherent in handling the actual blades, can be immediately appreciated. In addition, since the tabs holding the blades in this construction are made from stamped metal, there has been great difficulty in ensuring that the blades as inserted are properly oriented and aligned. Moreover there has been a consequent tendency for such blades, once positioned, to wander out of orientation or alignment. Therefore, to ensure proper and continued operation of the cutting surface has been difficult for the operator. In addition, in view of the fact that stamped metal has been used, it has been impossible to design a cutting surface which is adaptable for either king size or regular cigarettes: such a cutting surface would have required so many tabs that the metal sheets would have lost much of their strength.

In the cigarette making machine described and illustrated in Sledge's U.S. Pat. No. 3,515,147, only a single blade is held at the cutting surface, the machine being designed only for making two cigarettes at a cut. Thus, problems of alignment of the blade have no significance with this machine. In the construction described, the blade is held in position by screws. For the operator to change the blade, these screws must be untightened and retightened, and the operator must again handle the blade itself when removing it from or placing it in the cutting surface. Such a means of holding the blade in place would be unacceptable where an array of blades on the cutting surface is required since tightening and untightening the screws for each blade as well as obtaining uniform orientation and alignment of the blades would be extremely difficult.

Accordingly, it is an object of the present invention to provide an improved means of removing the blades from and inserting them into the cutting surface of a machine having a series of blades with reduced risk to the operator. It is a further object of the invention to provide a more economical, more reliable means of achieving uniform orientation and alignment of blades in such a cigarette making machine.

SUMMARY OF THE INVENTION

In accordance with the invention, a manually operated, apron-type machine for making cigarettes has been provided with a combined plastic cutting surface for cutting the long cigarette and a receiving surface for collecting cut cigarettes wherein the cutting blades are fixedly engaged in plastic blade holders. A series of parallel slots transversly spaced a predeterminded distance from each other extends inwardly from the rear edge of the cutting surface in the direction of movement of the tray. These slots are adapted to frictionally engage the blade holders to maintain the blades in proper orientation and alignment during operation of the machine. This construction permits the blade holders and not the blades themselves to be handled when being inserted into or removed from the cutting surface. Not only does this result in much greater safety when changing blades, it also permits much greater ease of handling when the blades are replaced. As well, the cutting tray according to the present invention ensures more uniform orientation and alignment of the blades when in position.

BRIEF DESCRIPTION OF THE DRAWINGS

Other objects and advantages of the invention will become apparent upon reading the following detailed description and upon referring to the drawings in which.

While the invention will be described in connection with an example embodiment, it will be understood that it is not intended to limit the invention to that embodiment. On the contray, it is intended to cover all alternatives, modifications and equivalents as may be included within the spirit and scope of the invention as defined by the appended claims.

DETAILED DESCRIPTION OF THE INVENTION

Figure 1:
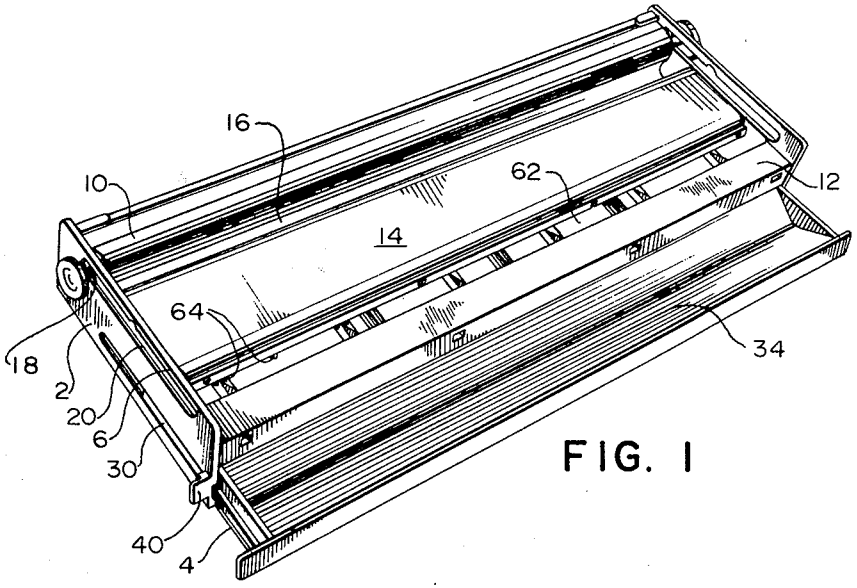
FIG. 1 is a perspective view of a cigarette making machine according to the present invention.
Figure 2:
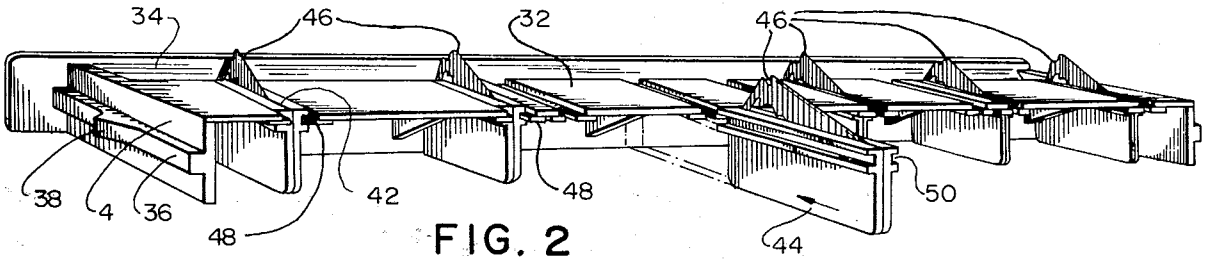
FIG. 2 is a rear perspective view of a cutting tray according to the present invention, the tray having been removed from the machine frame.
Figure 3:
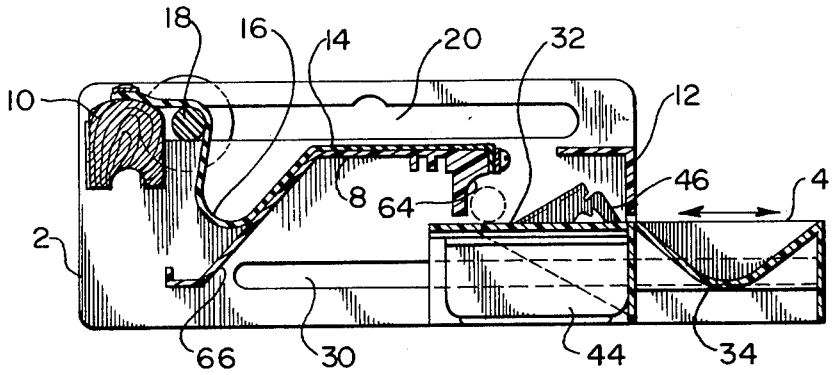
FIG. 3 is a sectional view along line III—III in FIG. 1.

Turning first to FIGS. 1 to 3, there is shown an improved cigarette maker according to the present invention having frame 2 and cutting tray 4 slidable therein. Frame 2 consists of sides 6 between which extend platform 8 (best seen in FIG. 3), rear ledge 10 and blade guard 12. Flexible apron 14 (for example made from rubberized cloth) is fixed at the front to front edge of platform 8, and at the back to rear ledge 10. Cigarette forming trough 16 is seen in FIG. 3 between the rear of platform 8 and the front of rear ledge 10, and is formed from slack in flexible apron 14. Steel roller 18 is positioned beneath apron 14 and is guided for forward and backward movement above platform 8 by guide 20 in sides 6. While it is not illustrated, it will be understood that tobacco placed in trough 16 is compressed and rolled onto a cigarette paper by a moving bight which is formed in the apron by moving the roller forward in guide 20.

Cutting tray 4 (best shown in FIGS. 2 and 3), slides forwardly and rearwardly with respect to frame 2 within guides 30 in each side 6 of the frame. The cutting tray is made of any suitable plastic and consists of a rear cutting surface 32 and integrally joined front cigarette receiving surface 34. Lateral projections 36 on each side of the tray slidably engage guides 30. Stop 38 is positioned along projection 36 to strike abutment members 40 at the front edge of guides 30 and thereby restrict the forward movement of the cutting tray during normal operation of the machine. By spreading the lower front corners of sides 6 so that stops 38 are free of abutment member 40, the cutting tray may be readily removed from frame 2.

Cutting surface 32 has a series of spaced, parallel slots 42 extending inwardly from the rear thereof in the direction of movement of the tray. These slots engage blade holders 44 in which are firmly seated cutting blades 46. In the embodiment illustrated, parallel lateral lugs 48 on each side of slots 42 slide into grooves 50 on each side of blade holders 44 to frictionally engage the blade holders and cutting blades in place at the rear of slots 42 on cutting surface 32.

Figure 5:
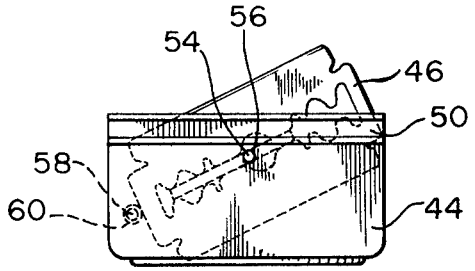
FIG. 5 is a side view of the blade holder of FIG. 4, encased about a cutting blade.
Figure 4:
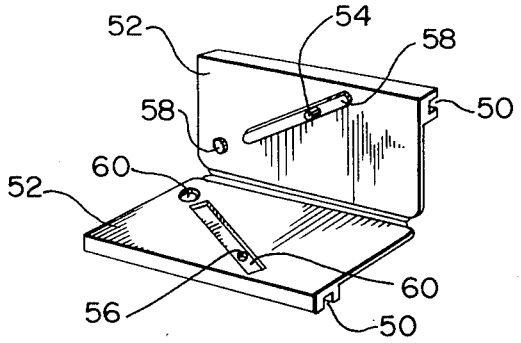
FIG. 4 is a perspective view of an open blade holder according to one embodiment of the present invention.

Referring to FIGS. 4 and 5, blade holders 44 may consist of two sides 52 having opposed interior surfaces for gripping the blade. Locking pin 54 projecting from the interior surface of one side cooperates with aperture 56 on the other side to block the sides in position about blade 46. Lugs 58 projecting from the inner surfaces of sides 52 and cooperating with depressions 60 on opposite inner surfaces of the side act to firmly position the blade 46 in proper orientation for cutting.

When a long cigarette has been formed on the apron it is then dropped down cutting slot 62 onto cutting surface 32. By sliding cutting tray 4 from its forward position into the machine frame, the long cigarette is brought to bear against aligned abutment members 64, these members being fixed to, and downwardly and rearwardly curved from, the front of the lower surface of platform 8. Each blade 46 has an abutment member 64 facing it, the abutment member being appropriately slotted to permit passage of the blade as the tray is moved inwardly. Additional abutment members may be provided to give additional support to the long cigarette during the cutting operation. The cut cigarettes are then nudged onto cigarette receiving surface 34, which may have a central, transverse depression as shown for receiving the cigarettes as illustrated in the drawings, as the cutting drawer reaches its rear position, to complete the cutting step.

It will be understood that cutting surface 32 must be spaced downwardly from the lower surface of platform 8 a sufficient distance to permit free and unobstructed cutting of the long cigarette, as well as free passage of the blades 46 during the cutting operation.

In addition, it will be understood that sufficient slots 42 may be provided, and properly spaced from each other, so that a number of either king size or regular cigarettes may be cut by the same cutting tray, depending upon the location of the array of blade holders and blades. In FIGS. 1 to 3, the blades are in fact positioned to cut five regular cigarettes. By removing the four interior blades and blade holders, and placing them in the three vacant slots, the cutting tray will be set up to cut four king size cigarettes from the long cigarette.

In the embodiment illustrated, transverse support web 66 (shown in FIG. 3) extends between sides 6 at the rear of platform 8 to provide additional support to the machine frame. As has been mentioned, one of the advantages of the cutting tray according to the present invention is that the blades may be simply removed from the machine for replacement, without the necessity of the operator handling the blades themselves, by sliding blade holders 46 from their frictionally engaged position at the rear of slots 42. To permit disengagement of these blade holders while cutting tray 4 is in position in the machine (as shown in FIG. 3), there must be sufficient space underneath platform 8 and in front of web 66 to permit this operation.

To remove the blade holders and blades, blade guard 12 need not be removed, as was the case with earlier cigarette making machines of this general type. Nor are additional tools such as screwdrivers, required. In addition one blade or as many blades as required may be changed, without exposing hands to more than one cutting surface at a time. Each blade holder also serves to protect the sharpness of the unexposed cutting surface, where double edged blades are used, until ready for use.

The cutting tray according to the present invention ensures that accurate, uniform and permanent orientation and alignment of the cutting blades can be achieved repeatedly, and simply and safely with an economical construction. The firm, fixed alignment of the blades as well as the exact positioning of the tray in the machine frame with a minimum of vertical movement, achieved by the tray according to the invention, ensures precise and clean cutting of the long cigarette.

Thus, it is apparent that there has been provided in accordance with the invention an improved cutting tray for a manual, apron-type cigarette making unit that fully satisfies the objects aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What we claim is:

1. In a manually operated machine for making cigarettes comprising (a) a frame; (b) a horizontal platform supported thereby, elongated in the transverse direction, abutment members depending and rearwardly curved from beneath the front portion of said platform; (c) a flexible apron covering the platform, and extending from the front of said platform to beyond the rear thereof, adapted to define a transverse cigarette-forming trough at the rear of said platform; (d) a roller slidable above said platform to form a bight therebetween adapted to compress and roll tobacco onto a piece of cigarette paper to form a long cigarette; and (e) a cutting tray spaced below the bottom surface of said platform and slidable in and relative to said frame between forward and rearward positions, said cutting tray having a forward receiving surface for collecting cut cigarettes and an adjacent rearward cutting surface, a series of transversely spaced, aligned, vertical, rearwardly slanted razor blades projecting from said cutting surface towards and cooperating with said abutment members to cut said long cigarette, an improved cutting tray wherein said blades are clamped in position in blade holders, and said cutting surface has a series of parallel slots transversely spaced a predetermined distance from each other, extending inwardly from the rear edge of said cutting surface in the direction of movement of said tray, said slots comprising engaging means which cooperate with said blade holders to frictionally and releasably engage said blade holders in said slots, whereby the blades and blade holders are maintained in proper orientation and alignment during operation of the machine.

2. An improved cutting tray according to claim 1 wherein said receiving surface has a central, transverse depression for receiving finished cigarettes.

3. An improved cutting tray according to claim 1 wherein said series of slots are arranged transversely along said cutting surface so that either king size or regular cigarettes may be cut by proper arrangement of the blades and blade holders.

4. An improved cutting tray according to claim 1 wherein parallel lateral lugs projecting from the surfaces of said slots cooperate with corresponding parallel lateral slots on opposite exterior surfaces of the blade holders to frictionally engage said blade holders.

5. An improved cutting tray according to claim 4 wherein said blade holders each consist of two sides, the inner surfaces of which have lugs co-operating with receptacles on the opposed inner surfaces for locking the sides together about a blade and for firmly positioning the blade in the desired orientation.

6. An improved cutting tray according to claim 1 wherein there is sufficient space provided beneath the platform to permit withdrawal or insertion of the blade and blade holder from the cutting tray when in forward position.

7. An improved cutting tray according to claim 1 wherein lateral projections on the sides of the tray slidably engage guides in the sides of the frame, whereby said tray is permitted to slide in and relative to said frame between forward and rearward positions with a minimum of vertical movement.

8. An improved cutting tray according to claim 1 wherein said cutting surface and said blade holders are made of plastic.

* * * * *